US009567136B2

(12) United States Patent
Myoung et al.

(10) Patent No.: US 9,567,136 B2
(45) Date of Patent: Feb. 14, 2017

(54) DIP CLIP

(75) Inventors: Sul Gi Myoung, Federal Way, WA (US); Jeffery David Madden, Fredericton, CA (US)

(73) Assignee: Progressive International Corporation, Kent, WA (US)

( * ) Notice: Subject to any disclaimer, the term of this patent is extended or adjusted under 35 U.S.C. 154(b) by 1277 days.

(21) Appl. No.: 13/359,243

(22) Filed: Jan. 26, 2012

(65) Prior Publication Data

US 2012/0199597 A1 Aug. 9, 2012

Related U.S. Application Data

(60) Provisional application No. 61/440,535, filed on Feb. 8, 2011.

(51) Int. Cl.
*B65D 21/02* (2006.01)
*B65D 25/22* (2006.01)

(52) U.S. Cl.
CPC ..... *B65D 25/22* (2013.01)

(58) Field of Classification Search
CPC ..... B65D 818/3205; B65D 1/326; B65D 5/42
USPC ..... 220/23.4, 23.2, 23.83, 23.86, 705, 386,220/751
See application file for complete search history.

(56) References Cited

U.S. PATENT DOCUMENTS

| | | | | |
|---|---|---|---|---|
| 2,307,882 | A * | 1/1943 | Freud | A47G 23/0225 220/23.4 |
| D385,462 | S * | 10/1997 | Ferris | D7/543 |
| 5,687,873 | A * | 11/1997 | Jones | B44D 3/123 220/736 |
| 5,853,158 | A * | 12/1998 | Riggle | A47G 23/0225 248/103 |
| 6,076,700 | A | 6/2000 | Manges | |
| D447,012 | S | 8/2001 | Owens et al. | |
| D479,994 | S | 9/2003 | Cendejas | |
| D607,275 | S | 1/2010 | Griffith | |
| 7,874,449 | B1 * | 1/2011 | Studee | A47G 19/02 206/219 |
| 2003/0019871 | A1 | 1/2003 | Nance | |
| 2008/0149634 | A1 * | 6/2008 | Osborne | A47G 21/145 220/23.83 |
| 2008/0290089 | A1 | 11/2008 | Ciarrocchi, Jr. | |
| 2009/0121107 | A1 * | 5/2009 | Lagobi | A47G 23/0225 248/311.2 |

OTHER PUBLICATIONS

"Arta Tasto Silicone Dipping Pouches," Amazon, http://www.amazon.com/Arta-Medium-Silicone-Dipping-Pouches/dp/B002CGS4XU, 5 pages, Printed Jun. 17, 2011.

* cited by examiner

*Primary Examiner* — King M Chu
(74) *Attorney, Agent, or Firm* — Lowe Graham Jones, PLLC

(57) ABSTRACT

A dip clip includes a container portion and a clip portion. The container portion is configured to hold a desired quantity of a dip such as salsa, dressings, or other such food items. The clip portion is configured to provide a point of attachment so that the container portion may be removably attached to a plate or other dish.

7 Claims, 3 Drawing Sheets

DIP CLIP

PRIORITY CLAIM

This application claims the benefit of provisional application Ser. No. 61/440,535 filed Feb. 8, 2011, the contents of which are incorporated by reference.

FIELD OF THE INVENTION

This invention generally relates to bowls or other containers for holding salsa or other dips.

SUMMARY OF THE INVENTION

A dip clip in accordance with the present invention includes a container portion and a clip portion. The container portion is configured to hold a desired quantity of a dip such as salsa, dressings, or other such food items. The clip portion is configured to provide a point of attachment so that the container portion may be removably attached to a plate or other dish.

In accordance with preferred aspects of the invention as described in more detail below, the clip portion may include upper and lower arms that are separable to receive a portion of a plate, frictionally securing the plate between the upper and lower arms to hold the dip clip to the plate or other dish.

DETAILED DESCRIPTION OF THE PREFERRED EMBODIMENT

Figure 1:
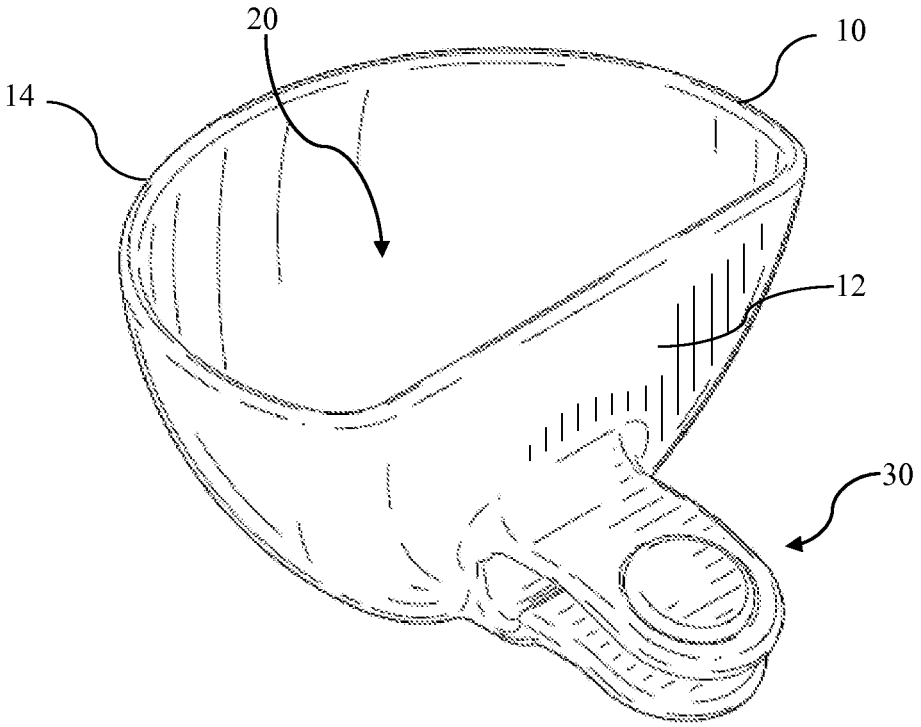
FIG. 1 is a perspective view of a preferred dip clip.
Figure 2:
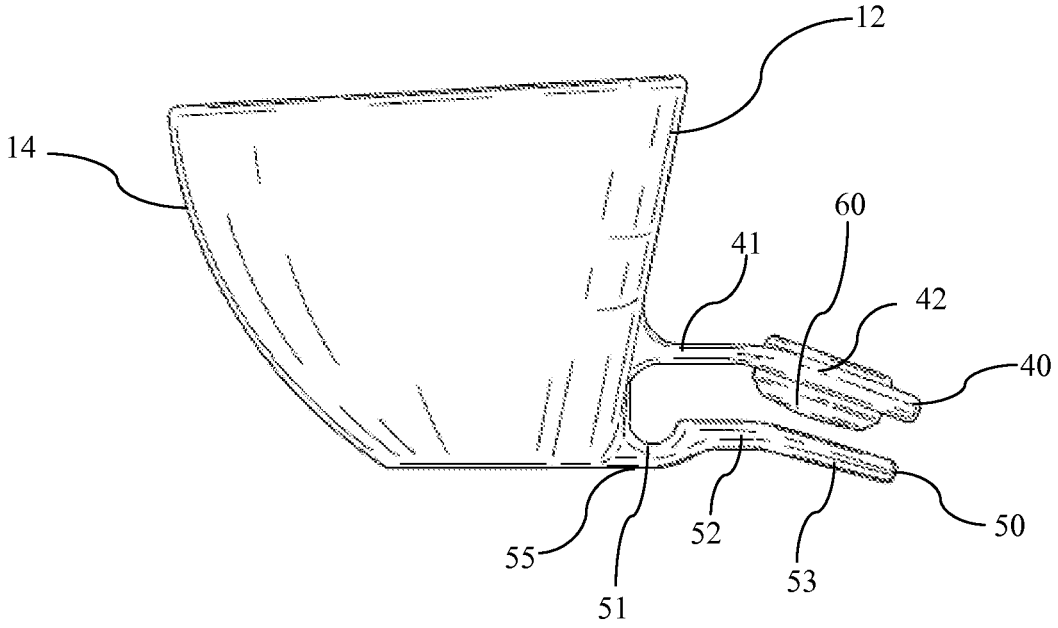
FIG. 2 is a side view of a preferred dip clip.

A preferred dip clip in accordance with this invention includes a container or bowl 10 forming an interior space 20. The container portion may have any size or shape, though in a preferred example the container has a capacity of about ⅓ cup to ½ cup. This size is suitable as an individual portion size, ideal for use when attached to an individual-sized plate 70. In other versions the container may be larger or smaller, as desired for particular uses.

As viewed from the top or a side, the bowl portion preferably is formed with a substantially flat side 12 and an opposing arched side 14. The flat side is intended to be positionable adjacent an edge of a plate or platter, and is shaped to have a substantially flat side so that it does not extend significantly over the surface area defined by the plate or platter. Thus, the flat side is designed to be positioned generally tangentially to an edge of a circular plate or platter. The opposite arched side preferably bows outwardly in order to create a suitably sized interior space for receiving the dip or other food item. In other versions, the rim and bowl of the container portion may have a different shape, such as a cubic rectangle or an entirely round shape instead of flat truncated hemisphere.

The clip portion 30 extends laterally away from the flat side 12 of the bowl, preferably from a position at the bottom of the container portion. In the preferred version, the clip portion comprises an upper arm 40 and a lower arm 50, with the upper and lower arms being positioned adjacent one another and configured to receive an edge of a plate or platter between them. Ideally, at least one of the upper or lower arms is sufficiently flexible to move apart from the other arm to receive an edge of the plate and to impart a gripping force on the edge of the plate to hold the dip clip to the plate. In other versions both of the upper and lower arms have a degree of flexibility to allow the clip to be removably secured to the plate.

The lower arm 50 extends laterally away from the lower portion of the container portion, and in the illustrated version it extends laterally away from the lower portion of the flat side of the container portion. Accordingly, a first portion 55 of the lower arm defines a bottom surface that is substantially co-planar with the lower surface of the container portion of the dip clip.

The upper surface 51 of the first portion 55 of the lower arm is formed with a channel that is sized and configured to receive a rim of a plate. Thus, the channel is preferably rounded in cross-section. In addition to being shaped to receive a portion of a rim of a plate, the channel may be configured to enable the lower arm to pivot at the point of the channel, depending on the thickness of the material used at the location of the channel. The first portion of the lower arm transitions to an intermediate portion 52 that extends laterally away from the container and is nearly or substantially parallel with the lower surface of the bowl.

Finally, the lower arm includes an angled portion 53 adjacent the intermediate portion. The angled portion is angled downward somewhat with respect to the axis defined by the intermediate portion. In one version, the angled portion is oriented downwardly at an angle of about 30 degrees with respect to the intermediate portion. As illustrated, the length of the angled portion is approximately equal to the length of the combined first portion and intermediate portion. In this regard, the illustrated examples are intended to be drawn to scale, though in other versions the dimensional relationships may be altered.

The upper arm 40 includes a first lateral portion 41 and a second angled portion 42. The first lateral portion extends laterally away from the container portion and is attached to the flat side of the container portion at a position above that of the lower arm. The upper and lower arms are spaced apart from one another by a distance sufficient to snugly receive a rim of a plate or platter between them.

The angled portion 42 of the upper arm is angled downward with respect to the axis defined by the upper, such that the angled portion of the upper arm is generally parallel to the angled portion of the lower arm. In a preferred version, however, the angles of the upper and lower portions may be slightly offset from one another such that the two portions are not quite parallel. In such a version, the tips of the upper and lower angled portions are closer to one another than any other position along either portion. As illustrated, the upper arm and lower arm are substantially the same length as one another.

The upper arm may include a resilient pad 60. The resilient pad in the preferred example is formed from silicone or any other substantially resilient material. In one version it is formed as a generally cylindrical shape having an intermediate channel. The upper arm is formed with a round hole shaped to be received within the channel of the resilient pad to secure the pad to the upper arm. In other versions, the resilient pad may be molded, glued, or otherwise attached to the arm. Likewise, the resilient pad need not extend through the upper arm, but may alternatively be attached to a lower surface of the upper arm or may be integrally formed from the same material used for the upper arm. In this latter version, the pad may not be resilient if the material used for the upper arm is not resilient. Still further, the resilient pad may be formed on the lower arm rather than the upper arm.

In the preferred version as illustrated, the resilient pad forms a surface that extends between the angled portions of the upper and lower arms. By extending into the space between the arms, the resilient pad provides greater force against a portion of a plate that is positioned between the upper and lower arms. In addition, when the pad is formed from a resilient material it is at least somewhat compressible, thereby allowing for more flexure for receiving a rim of a plate while providing sufficient force to hold the clip to the plate. Likewise, the pad, together with the resilience of the arms, allows the clip to accommodate a variety of plates having differing thicknesses.

In some versions of the invention, the arms are substantially rigid and the clip relies primarily on the resilient qualities of the pad to retain and release a plate from the clip.

In use, the clip portion is placed adjacent a rim of a plate and the plate is pushed into the space defined between the upper and lower arms. The resilient nature of the arms or the resilient pad allows them to be forced apart somewhat to snugly receive the rim of the plate. Once in position, the frictional force urging the arms toward one another (and/or the natural return force of the resilient pad) holds the clip portion in place about an edge of the rim of the plate. The bowl portion may be filled with salsa or another dip, thereby providing a vessel for holding dip along an edge of the plate.

Figure 3:
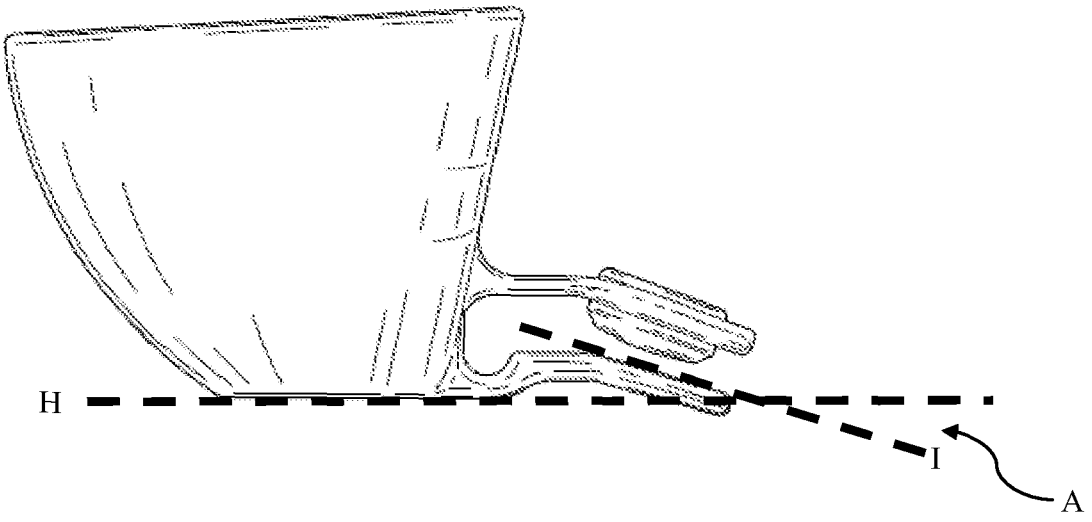
FIG. 3 is a side view of a preferred dip clip.

The angled orientation of the clip with respect to the container is further illustrated in FIG. 3. As shown, the base of the container forms a planar floor in the preferred example, substantially along a plane H in FIG. 3. An upper surface of the lower arm of the clip is inclined along line I, which as explained above is preferably about 30 degrees (indicated by angle A) of incline with respect to the horizontal axis H. Because a peripheral rim of a plate is typically tipped upward, this angled orientation of the clip allows the plate to be received at the angle of the plate rim while maintaining the container in a horizontal configuration. Likewise, the configuration of the clip with respect to the base of the container ensures that the base of the container remains above a horizontal surface on which the plate is resting when the clip is attached to the plate.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

We claim:

1. A method for serving a food item, comprising:

obtaining a dip clip, the dip clip comprising a container having an upper rim, a base, and a sidewall extending from the base to the rim to define an interior space, and a clip attached to the container and extending laterally away from the base, the clip being removably attachable to a plate, and further wherein the dip clip comprises an upper arm and a lower arm, each of the upper arm and lower arm being integrally formed with the container;

wherein at least one of the upper arm and the lower arm is movable apart from the other one of the upper arm or the lower arm to receive a rim of a plate and wherein the lower arm comprises a first portion adjacent the container, a lower angled portion, and an intermediate portion between the first portion and the lower angled portion, the first portion of the lower arm having a downward recessed channel;

attaching the dip clip to a rim of the plate; and filling the container of the dip clip with the food item.

2. The method of claim 1, wherein the step of filling the container is performed before the step of attaching the dip clip.

3. The method of claim 1, wherein the base of the container defines a base plane, and further wherein the clip is oriented to receive a rim of a plate at an angle inclined with respect to the base plane.

4. The method of claim 3, wherein the angle is less than about 30 degrees.

5. The method of claim 1, wherein the lower angled portion is inclined downward, relatively in the direction of the base.

6. The method of claim 1, wherein the upper arm further comprises a lateral portion and an upper angled portion, the upper angled portion being angled downward, relatively in the direction of the base.

7. The method of claim 1, wherein one of the upper arm and the lower arm comprises a resilient pad positioned in the space defined between the upper arm and the lower arm.

* * * * *